United States Patent [19]

MacAllister et al.

[11] Patent Number: 4,715,444

[45] Date of Patent: Dec. 29, 1987

[54] METHOD FOR RECOVERY OF HYDROCARBONS

[75] Inventors: Donald J. MacAllister, Carrollton; Virginia W. Pennington, Dallas, both of Tex.

[73] Assignee: Atlantic Richfield Company, Los Angeles, Calif.

[21] Appl. No.: 923,241

[22] Filed: Oct. 27, 1986

[51] Int. Cl.[4] ..... E21B 43/16; E21B 43/20

[52] U.S. Cl. ..... 166/269

[58] Field of Search ..... 166/261, 268, 269, 272

[56] References Cited

U.S. PATENT DOCUMENTS

| | | | |
|---|---|---|---|
| 2,994,375 | 8/1961 | Hurley | 166/261 X |
| 3,208,519 | 9/1965 | Moore | 166/261 |
| 3,289,758 | 12/1966 | Martin et al. | 166/269 |
| 3,405,761 | 10/1968 | Parker | 166/269 |
| 3,467,191 | 9/1969 | Van Daalen et al | 166/269 |
| 3,903,967 | 9/1975 | Woodward | 166/269 |
| 3,978,920 | 9/1976 | Bandyopadhyay et al. | 166/261 X |
| 4,088,188 | 5/1978 | Widmyer | 166/269 |
| 4,392,530 | 7/1983 | Odeh et al. | 166/269 |
| 4,418,751 | 12/1983 | Emery | 166/261 |
| 4,493,369 | 1/1985 | Odeh et al. . | |
| 4,638,864 | 1/1987 | Bousaid | 166/269 X |
| 4,640,355 | 2/1987 | Hong et al. | 166/269 |

*Primary Examiner*—George A. Suchfield
*Attorney, Agent, or Firm*—F. Lindsey Scott

[57] ABSTRACT

A method for recovering hydrocarbons from a subterranean hydrocarbon-containing formation penetrated by at least two wellbores, said method comprising:

(a) injecting a gaseous stream into the formation near the bottom of the formation through a first wellbore;

(b) injecting an aqueous stream into the formation near the top of the formation through the first wellbore; and (c) recovering hydrocarbons from the formation through a second wellbore.

3 Claims, 1 Drawing Figure

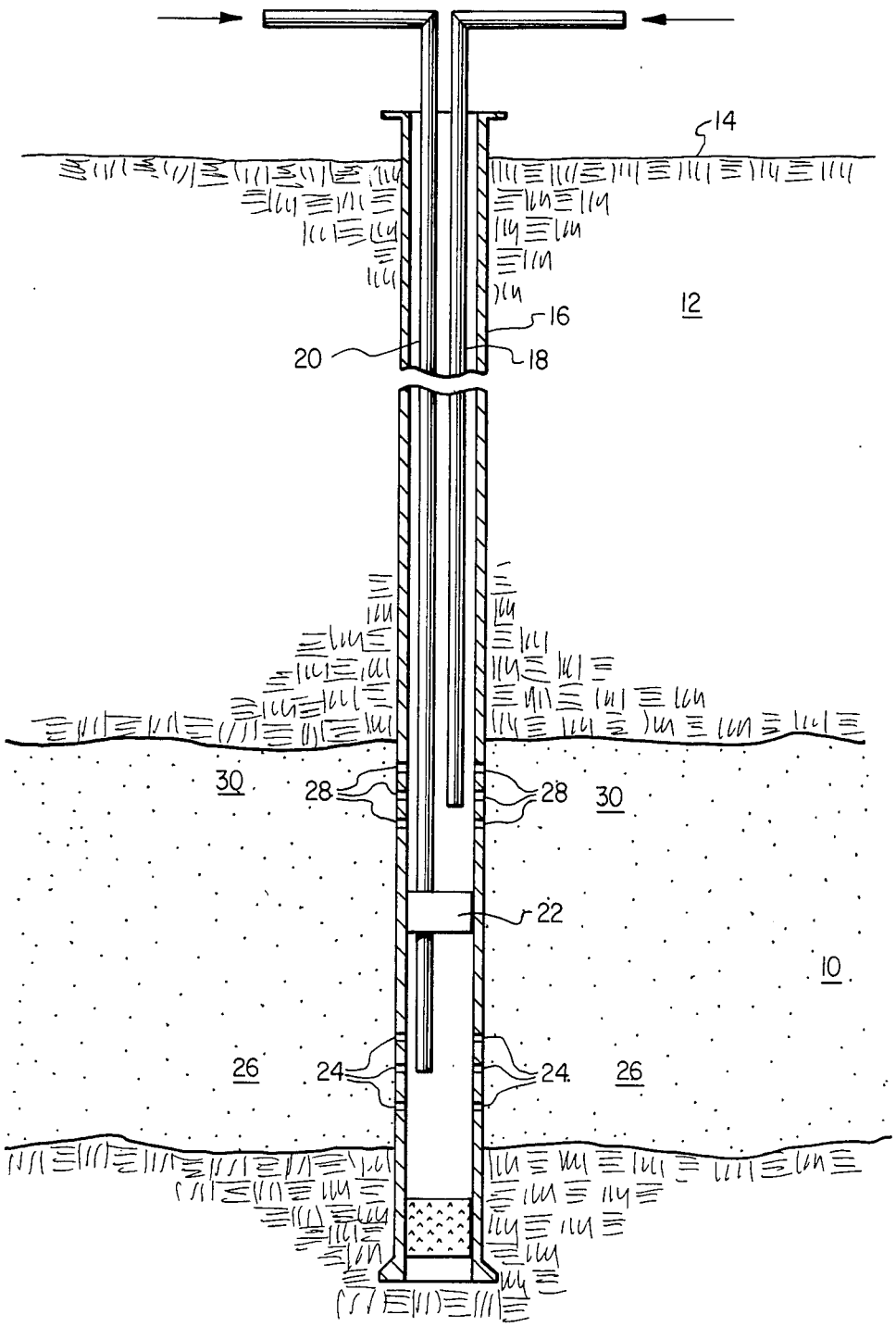
14
12
16
20
18
30
28
28
30
22
10
26
24
24
26

METHOD FOR RECOVERY OF HYDROCARBONS

This invention relates to the recovery of hydrocarbons from a subterranean formation by the use of gas injection into the formation.

This invention also relates to the recovery of hydrocarbons from a subterranean formation by the use of a combination of gas and water injection into the formation.

A variety of techniques have been used to enhance the recovery of hydrocarbons from subterranean formations from which the hydrocarbons no longer flow by natural forces. One such technicue is water injection, or water flooding, to force hydrocarbons from the subterranean formations by flowing water through the formations. While water injection has been effective in many instances, not all the hydrocarbons are recovered by water injection. The water has a tendency to flow to the bottom of the formation as it passes through the formation thus by-passing portions of the formation. Another technique is the use of gas injection which functions to force hydrocarbons, such as crude oil, from the subterranean formation by a combination of drive forces and a reduction of the viscosity of the hydrocarbons by absorption of the gas into the crude oil in the formation. Miscible gases such as $CO_2$, propane, and miscible natural gas may mobilize even more oil by single phase miscible displacement. The gas tends to rise to the top of the formation and "override" portions of the formation as it passes through the formation and to finger or flow through the paths of least resistance in the formation thus bypassing portions of the formation.

Processes involving a combination of water and gas injection have been used by alternately injecting water and gas into subterranean formations. These processes have generally resulted in good areal sweep of the formation but the injection of the water and gas in this fashion results in slowing the flow of the injected materials through the formation and may not result in good vertical sweep in some formations.

As known to those skilled in the art, the presence of small bubbles or quantities of gas in the subterranean formation greatly slows the flow of liquid through the formation. The gas is presently believed to block the liquid flow at the interface between the gas and the liquid slugs in the pores of the formation. As a result, good areal coverage of the formation has been accomplished by alternate water and gas injection but the flow of injected material through the formation is slower than desired.

Accordingly, a continuing effort has been directed to the development of a method whereby improved vertical sweep can be achieved.

It has now been found that such an objective is accomplished by a method for recovering hydrocarbons from a subterranean hydrocarbon formation penetrated by at least two wellbores by a method comprising:

(a) Injecting a gaseous stream into the formation near the bottom of the formation through a first wellbore;

(b) Injecting an aqueous stream into the formation near the top of the formation through the first wellbore; and (c) recovering hydrocarbons from the formation through a second wellbore.

The FIGURE is a schematic diagram of an embodiment of the present invention.

In the FIGURE, a subterranean hydrocarbon-containing formation 10 is shown beneath an overburden 12 and penetrated from the surface 14 by a cased wellbore 16. Cased wellbore 16 contains a first tubing 18 and a second tubing 20. First tubing 16 extends to a portion of wellbore 16 opposite an upper portion 30 of formation 10. Second tubing 20 extends through a packer 22 to a portion of wellbore 16 near a bottom portion 26 of formation 10. Wellbore 16 is completed and cased by means known to those skilled in the art and first tubing 16 and second tubing 18 are positioned in wellbore 16 by means known to those skilled in the art. Similarly, packer 22 is a conventional packer and is positioned to prevent the entry of water or gas into undesired portions of the casing. Casing 16 is perforated in lower portion 26 of formation 10 by a plurality of perforations 24 and in upper portion 30 of formation 10 by a plurality of perforations 28.

In the practice of the method of the present invention, a suitable gaseous material is injected into lower portion 26 of formation 10. Injection is suitably accomplished at a pressure which is sufficient to accomplish the desired injection rate.

A variety of gaseous materials can be used. The primary criteria for the gaseous material is that it be gaseous at the temperature and pressure in the subterranean formation. Suitable gases are carbon dioxide, nitrogen, light hydrocarbon gases such as methane, ethane, propane, butane and the like and mixtures thereof. The selection of a suitable gaseous material is within the skill of those in the art based upon a knowledge of the temperature and pressure conditions in the subterranean formation. It is greatly preferred that the gaseous material remain gaseous as it passes through the subterranean formation. While certain of the suitable gaseous materials may be, and desirably are, absorbed to a greater or lesser degree in the crude oil to reduce its viscosity, etc, it is preferred that the gaseous material be a material which does not condense or liquify as it passes through the subterranean formation.

The aqueous stream may be water, brine, or the like as considered suitable for injection into the particular formation. Upon injection of the materials, the gaseous material is injected into lower portion 26 of formation 10 and flows toward a second well (not shown) thereby enhancing the recovery of hydrocarbons from formation 10 through the second well. As the gaseous material is injected, an aqueous stream is injected into upper portion 30 of subterranean formation 10. As the materials move through formation 10, the aqueous materials tend to slump or move lower in formation 10 and the gaseous materials tend to rise in formation 10 to ultimately override formation 10. As the materials move through formation 10 toward the recovery well an interference zone is created in which the gaseous material moving upward and through the formation is mixed with the liquid moving downward and through the formation. This interference zone moves through the formation toward the recovery well providing a good vertical sweep of formation 10 and providing improved recovery at a greater rate than has heretofore been accomplished using alternate injections of water and gas through a common injection point. In some formations where good vertical sweep is not achieved by the use of alternate water and gas injection, comparable or greater recovery is achieved by the use of the present method than has been achieved by alternate injection of slugs of water and gas over much longer periods.

While it is preferred that the water and gas be injected substantially continuously and simultaneously, the injection of either or both may be periodically interrupted for periods of time. The injection rates may vary widely dependent upon the properties of the particular formation. Similarly, the amounts of injected material may vary widely although volumes typically injected vary from about 10 to about 50 percent of the hydrocarbon pore volume (HCPV) of the formation when gas is injected alone and from about 50 to about 300 percent of the HCPV when water is injected alone. The determination of a suitable volume and injection rate is considered to be within the skill of those in the art.

Alternatively, it may be desirable to periodically reverse the injection for short periods. During such periods of reverse injection, the gaseous material is injected into the upper portion 30 of formation 10 with the aqueous material being injected into lower portion 26 of formation 10. The reverse injection tends to create zones of interference along the entire width of formation 10 for a short period of interference sweep through the formation. Such short periods of injection can result in improved areal sweep without greatly reducing the time required for the recovery of hydrocarbons from the formation.

Having discussed the invention with reference to certain of its preferred embodiments, it is pointed out that the embodiments discussed are illustrative rather than limiting in nature and that many variations and modifications are possible within the scope of the invention. Many such variations and modifications may be considered obvious and desirable to those skilled in the art based upon a review of the foregoing description of preferred embodiments and the following example.

EXAMPLE

The example considers three permeability descriptions: homogeneous (HO), a random distribution, i.e. areas of varied porosity and permeability randomly distributed in the formation (RD), and random distribution with vertical flow barriers scattered throughout the reservoir (RB). The homogeneous case investigated the effect of gravity separately from reservoir description. A two-dimensional vertical cross-section of a quarter five spot is used to model a representative portion of the reservoir. The random distribution and random distribution with vertical flow barriers are based on a geologic study of a reservoir using $CO_2$ as the injected gas. Conditions at the start of $CO_2$ injection are estimated by injecting water at the reservoir discovery conditions of 0.57 oil saturation (57 percent of the reservoir pore volume), 0.43 connate water saturation (43 percent of the reservoir pore volume), and 4000 PSI average reservoir pressure until a produced water to oil ratio (WOR) of greater than 13.5 results. This WOR matchs the field WOR ratio at the start of $CO_2$ injection. The table lists the oil recovery results of all simulation runs.

The viscous to gravity ratio is low and $CO_2$ displacement is unstable with respect to gravity and severe gravity over-ride occurs with the HO description. Fingering of $CO_2$ through high permeability channels improves vertical sweep efficiency in the RD description. Vertical flow barriers reduce the effect of gravity over-ride by inhibiting gravity over-ride in the RB description.

The effect of alternate water and gas (WAG) injection was determined by modeling a 1:1 water to $CO_2$ injection ratio with 90 day cycles; approximately 0.05 HCPV of fluid is injected during each cycle until 0.5 HCPV of $CO_2$ is injected (0.5 HCPV of water is also injected). The last $CO_2$ injection cycle is followed by continuous water injection until oil production falls to 2 STB/D (Stock Tank Barrels per Day). This results in a decrease in oil recovery compared to continuous $CO_2$ injection for all descriptions. The water slumps under the $CO_2$ restricting $CO_2$ to the top layers of the reservoir and enhancing gravity over-ride of $CO_2$. WAG injection has a negative effect on oil recovery because the water slumps and retards gravity over-ride only near the injector while restricting $CO_2$ from the higher layers away from the injector.

The effect of dual injection was determined by modeling the simultaneous injection of a 1:1 ratio of water and $CO_2$ with $CO_2$ injected in the bottom four layers and water injected in the top four layers of the reservoir; 0.5 HCPV of $CO_2$ is injected (0.5 HCPV of water is also injected). This is followed by continuous water injection until oil production falls to 2 STB/D. This results in an increase in oil recovery compared to continuous $CO_2$ injection for all descriptions. The water slumps over the over-riding $CO_2$, restricting gravity over-ride of $CO_2$ and leading to better vertical conformance. With the RB description, the barriers prevent $CO_2$ over-ride and oil recovery suffers because $CO_2$ is only injected in four out of ten layers.

TABLE OF SIMULATED OIL RECOVERIES

| Permeability Description | Continuous $CO_2$ Injection (HCPV %) | Alternate Water and Gas Injection (HCPV %) | Dual Injection (HCPV %) |
|---|---|---|---|
| HO | 15.7 | 14.9 | 21.7 |
| RD | 18.7 | 16.3 | 22.7 |
| RB | 21.2 | 18.7 | 16.7 |

The simulated oil recoveries for each process evaluated for each type formation evaluated are shown in the Table. Clearly the use of dual injection results in increased oil recovery for both the HO and RD type formations.

Having thus described the invention, we claim:

1. A method for recovering hydrocarbons from a subterranean hydrocarbon-containing formation penetrated by at least two wellbores, said method comprising:
   (a) Injecting a gaseous stream into said formation near the bottom of said formation through a first wellbore said gas being gaseous at the temperature and pressure in said formation and selected from the group consisting of carbon dioxide, nitrogen, light hydrocarbon gases and mixtures thereof;
   (b) Injecting a liquid aqueous stream into said formation near the top of said formation through said first wellbore; and
   (c) Recovering hydrocarbons from said formation through a second wellbore wherein said gaseous stream and said aqueous stream are injected substantially simultaneously and substantially continuously.

2. The method of wherein said gaseous stream is injected at a pressure sufficient to achieve a desired injection rate.

3. A method for recovering hydrocarbons from a subterranean hydrocarbon-containing formation penetrated by at least two wellbores, said method comprising:

(a) Injecting a gaseous stream into said formation near the bottom of said formation through a first wellbore;

(b) Injecting an aqueous stream into said formation near the top of said formation through said first wellbore; and (c) Recovering hydrocarbons from said formation through a second wellbore;

wherein the injection of said gaseous material is periodically switched to said top of said formation and the injection of said aqueous stream is periodically switched to said bottom of said formation for a selected period.

* * * * *